US006705254B1

(12) United States Patent
Grabowski et al.

(10) Patent No.: US 6,705,254 B1
(45) Date of Patent: Mar. 16, 2004

(54) METHOD FOR COOLING TORQUE GENERATION ASSEMBLIES OF A HYBRID ELECTRIC VEHICLE

(76) Inventors: Tony Gary Grabowski, 35849 DeVille Dr., Sterling Heights, MI (US) 48188; Arun Kumar Jaura, 45166 Thornhill Rd., Canton, MI (US) 48188; Bruce Bruce Gailitis, 1739 Benjamin Avenue, Windsor, Ontario (CA); Gary D Barylski, 21479 Mayfair, Woodhaven, MI (US) 48183

( * ) Notice: Subject to any disclaimer, the term of this patent is extended or adjusted under 35 U.S.C. 154(b) by 0 days.

(21) Appl. No.: 10/064,603

(22) Filed: Jul. 30, 2002

(51) Int. Cl.[7] ..... F01P 3/00

(52) U.S. Cl. ..... 123/41.29; 123/41.31; 123/41.44

(58) Field of Search ..... 123/41.29, 41.31, 123/41.44

(56) References Cited

U.S. PATENT DOCUMENTS 4,836,147 A * 6/1989 Morris ..... 123/41.44
4,864,974 A * 9/1989 Aso ..... 123/41.31

FOREIGN PATENT DOCUMENTS

JP 11022460 A * 1/1999 ..... F01P/3/12

* cited by examiner

*Primary Examiner*—Noah P. Kamen
(74) *Attorney, Agent, or Firm*—Dykema Gossett; Carlos L. Hanze

(57) ABSTRACT

A method and an apparatus 12 for cooling one or more torque generation assemblies, such as an internal combustion engine 14 and/or an electric motor 16 by the use of variable speed pump assembly 28 which may be selectively operated without the use of any of the torque generation assemblies 12, 14.

15 Claims, 1 Drawing Sheet

METHOD FOR COOLING TORQUE GENERATION ASSEMBLIES OF A HYBRID ELECTRIC VEHICLE

BACKGROUND OF INVENTION

1. Field of the Invention

The present invention generally relates to a method and an apparatus for cooling torque generation assemblies, such as an internal combustion engine and an electric motor and to a vehicle utilizing such an apparatus, and more particularly to a hybrid electric vehicle having an internal combustion engine and an electric motor which are cooled by the use of a variable speed pump which may be selectively activated without the use of the internal combustion engine and the electric motor.

2. Background of the Invention

A vehicle typically utilizes a water pump which is physically coupled to a crankshaft by the use of a belt. More particularly, the engine operatively provides or generates torque which causes the crankshaft to rotate, thereby cooperating with the belt to cause the water pump to operate and to cause coolant to be communicated to the engine from a radiator assembly. While this configuration does desirably provide for the cooling of an engine, it has some drawbacks, especially when used within a hybrid electric vehicle in which torque is selectively generated by the use of an internal combustion engine and/or an electric motor, each of which must be cooled.

For example and without limitation, the previously delineated configuration requires that the engine remain or become operational in order to allow the water or coolant pump to be operational. This requirement, in a hybrid electric vehicle, is particularly undesirable since the internal combustion engine is frequently and purposefully rendered inoperable in order to conserve fuel and to reduce undesirable emissions while the required torque is generated by an electric motor. Hence, in order to cool the electric motor, the internal combustion engine, in a conventional configuration, must be operated even though it is not otherwise operationally necessary. Particularly, such operation reduces the previously delineated and sought-after benefits of such a hybrid configuration.

Moreover, the previously delineated configuration requires that the activation of the pump be dependent upon the activation of the engine and the operational speed of the pump be dependent upon the operational sped of the engine. Hence, should the electric motor require a relatively rapid or "quick" cooling, the internal combustion engine must be operated at a relatively high speed which causes the use of a relatively large amount of fuel and which increases the emission of larger amounts of undesirable constituents than are normally emitted at relatively slower speeds. Further, this dependence oftentimes causes the pump to be inefficiently operated (e.g., the pump is operated when cooling is not necessarily required) and causes the cooling assembly, such as the radiator and associated conduits and circuits, ("the radiator assembly") to be made larger than necessary in order to accommodate potential and relatively high engine speeds. Moreover, even at a relatively low required engine speed, the pump may be required to be run at high speed as the engine may be "hot" due to previous engine operation cycles, thereby causing the engine and the vehicle to be inefficiently operated.

Alternatively, to overcome the previously delineated drawbacks, two cooling assemblies are provided, one for the electric motor and one for the internal combustion engine. While this approach does allow a motor to be cooled without the use of an internal combustion engine, it undesirably increases the cost and complexity of the vehicle and still requires each of the cooling assemblies to have an operational speed which is dependent upon the respective torque generation assembly to which they are respectively and operationally coupled.

There is therefore a need for a new and improved method and apparatus for cooling a torque generation assembly and there is therefore a need for a vehicle, such as but not limited to a hybrid electric vehicle, which incorporates such a new and improved apparatus and method.

SUMMARY OF INVENTION

It is a first non-limiting advantage of the present invention to provide a method and an apparatus for cooling a torque generation assembly in a manner which overcomes some or all of the previously delineated drawbacks of prior cooling configurations.

It is a second non-limiting advantage of the present invention to provide a vehicle incorporating a method and an apparatus for cooling a torque generation assembly in a manner which overcomes some or all of the previously delineated drawbacks of prior cooling configurations.

It is a third non-limiting advantage of the present invention to provide a cooling assembly comprising a radiator assembly containing coolant; and a variable speed pump which is coupled to the radiator assembly and which is operable upon receipt of electrical power to transfer coolant from the radiator assembly.

It is a fourth non-limiting advantage of the present invention to provide an assembly for selectively cooling a motor assembly of a hybrid electric vehicle of the type having an internal combustion engine. Particularly, the assembly comprises a radiator assembly which contains coolant and which is coupled to the internal combustion engine and to the motor assembly; a source of energy; a selectively energizable variable speed pump which is coupled to the radiator assembly; and a controller which is coupled to the variable speed pump and to the source of energy and which selectively energizes the variable speed pump by communicating electric energy to the variable speed pump from the source of energy, effective to cause the variable speed pump to communicate coolant to the motor without the use of the motor and without the use of the internal combustion engine.

It is a fifth non-limiting advantage of the present invention to provide a hybrid vehicle comprising an internal combustion engine; a battery; a motor; a variable speed pump; a reservoir of coolant which is coupled to the internal combustion engine and to the motor; and a controller which selectively activates the variable speed pump by coupling the battery to the variable speed pump, effective to cause the variable speed pump to communicate coolant from the reservoir to the motor without the use of the internal combustion engine and without the use of the motor.

It is a sixth non-limiting advantage of the present invention to provide a method for cooling an engine which may be operable at a certain speed Particularly, the method comprises the steps of providing a reservoir of coolant; providing a variable speed pump assembly which may be operated at a speed which is independent of the speed of the engine; and coupling the variable speed pump to the engine and to the reservoir of coolant, thereby communicating coolant from said reservoir to said engine.

These and other features, and advantages of the present invention will become apparent from a consideration of the following detailed description of the preferred embodiment of the invention and by reference to the following drawings.

DETAILED DESCRIPTION

Figure 1:
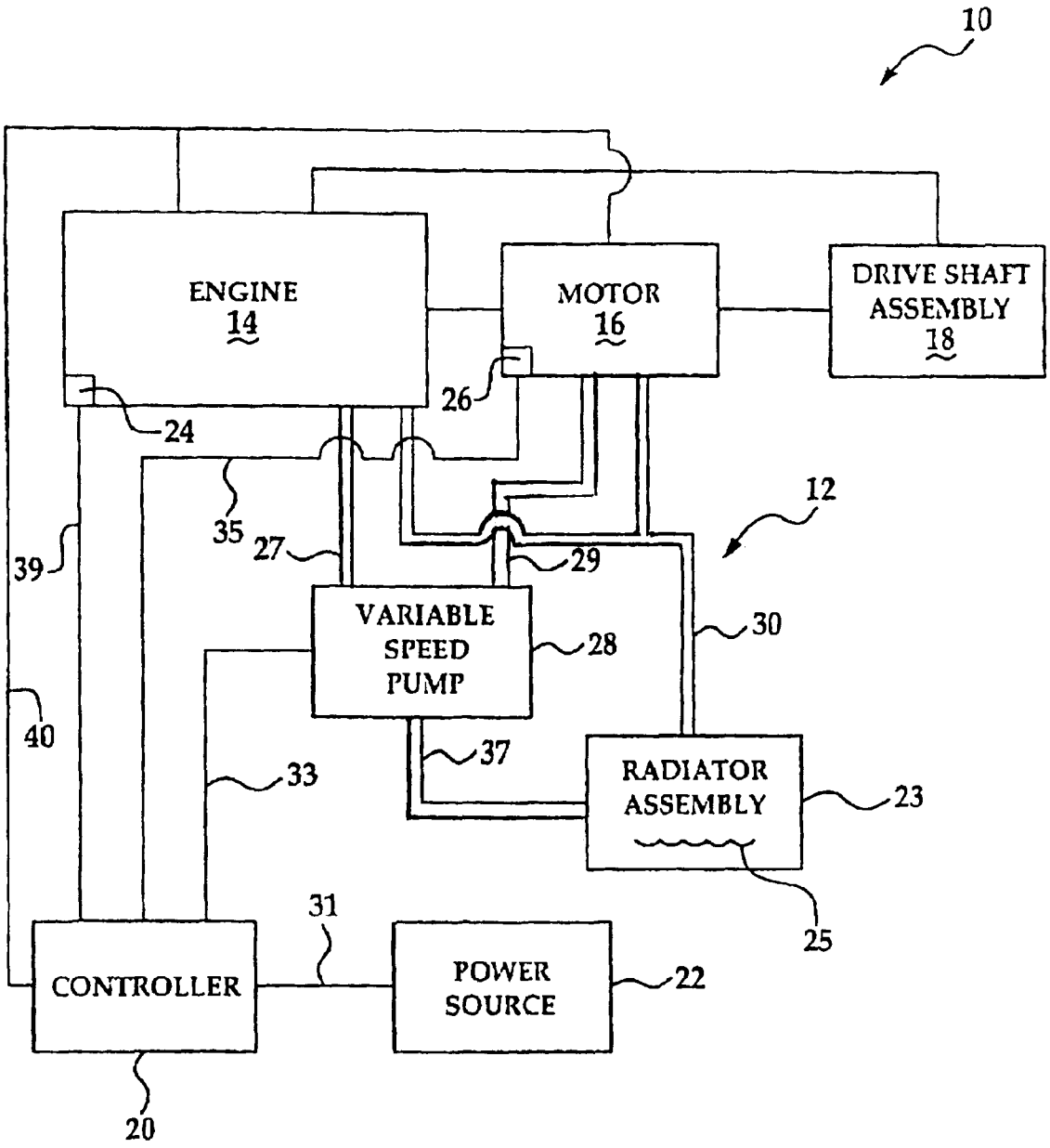
FIG. 1 is a block diagram of a cooling assembly which is made in accordance with the teachings of the preferred embodiment of the invention used within a hybrid electric vehicle.

Referring now to FIG. 1, there is shown a portion of a hybrid electric vehicle 10 incorporating a cooling assembly 12 which is made in accordance with the teachings of the preferred embodiment of the invention.

As shown, the hybrid electric vehicle 10 includes a conventional internal combustion engine 14, an electric motor 16, and a driveshaft or transmission assembly 18. Particularly, the driveshaft or transmission assembly 18 comprises various conventional elements, including a driveshaft, which cooperatively allow torque energy to be delivered to the vehicle wheels.

Particularly, the internal combustion engine 14 and the electric motor 16 are each physically and operatively coupled to the driveshaft assembly 18 and the internal combustion engine 14 is physically and operatively coupled to the electric motor 16.

The hybrid electric vehicle 10 (or cooling assembly 12) includes a controller 20, which is operable under stored program control, and a power or energy source 22 which may comprise a conventional vehicle battery. Controller 20 is physically and communicatively coupled to the power source 22, by bus 31, and is physically and communicatively coupled to the internal combustion engine 14 and to the electric motor 16 by the use of bus 40.

In operation, the controller 20, by use of signals transmitted to the internal combustion engine 14 and/or to the electric motor 16, by use of bus 40, selectively activates the engine 14 and/or the motor 16 and causes the driveshaft assembly 18 to be "driven" or rotated by the torque generated by the internal combustion engine 14 and/or from the electric motor 16.

Cooling assembly 12 includes a radiator assembly 23 which includes a radiator having a supply of coolant or water 25, a first temperature sensor 24 which is located within and/or upon the internal combustion engine 14 and which senses the temperature of the internal combustion engine 14, a second temperature sensor 26 which is located within and/or upon the electric motor 16 and which senses the temperature of the electric motor 16, and a variable speed pump 28.

As shown, the variable speed pump 28 is physically and controllably coupled to the controller 20, by bus 33, and is operatively coupled to the radiator assembly 23, to the internal combustion engine 14, and to the electric motor 16 by respective conduits 37, 27, and 29. The first and second temperature sensors 24 and 26 are communicatively coupled to the controller 20 by respective busses 39 and 35. The radiator assembly 23 is physically and communicatively coupled to the internal combustion engine 14 and the electric motor 16 by use of the conduit 30.

In operation, controller 20 selectively causes either the internal combustion engine 14 and/or the electric motor 16 to "operate the vehicle" by rotating the driveshaft assembly 18. Controller 20 receives the temperature signals which emanate from the temperature sensors 24, 26 and based upon the sensed temperature of the currently operating torque generation assembly 14, 16, determines whether to cause coolant 25 to be communicated to the currently operating torque generation assembly 14, 16. In some operational modes, both assemblies 14, 16 may be substantially and simultaneously operating. In one non-limiting embodiment, controller 20 stores a temperature threshold value which, when exceeded by the temperature of the operating assembly 14, 16, causes controller 20 to allow coolant 25 to be communicated to the operating assembly 14, 16 until the temperature of the operating assembly 14, 16 is reduced by a certain amount. Alternatively, coolant 25 is always communicated to the operating assembly 14, 16. Should the sensed temperature of the operating assembly 14, 16 exceed this threshold value, controller 20 causes the flow rate of the coolant 25 to increase by some predetermined amount which is proportional to the amount by which the threshold value has been exceeded. Such "increased flow rate" is maintained until the temperature of the operating assembly 14, 16 is reduced by a predetermined amount.

If coolant 25 is to be communicated to one or both of the torque generation assemblies 14, 16, controller 20 "initiates" the cooling assembly 12 by generating a signal to the pump 28 which allows electrical power to be communicated to the pump 28 from the power source 22 and which defines the path or the conduit (e.g., conduit 27 and/or conduit 29), that the fluid 25 is to travel within from the pump 28, thereby causing the fluid or coolant 25 to be communicated to the targeted torque generation assembly 14, 16 for some predetermined time and at a certain predetermined speed or flow. Once the fluid or coolant 25 traverses one or both of the torque generation assemblies 14, 16, it returns to the reservoir or the radiator assembly 23 by the use of a common or "shared" conduit 30. In this manner, common or shared conduit 30 cooperates with conduits 27, 29 to form a single circuit or "loop" from the radiator assembly 23, through the a first of the torque generators 14, 16, and back to the radiator assembly 23 and a second circuit or "loop" form the radiator assembly 23, through a second of the torque generators 14, 16, and back to the radiator assembly 23.

In this manner, neither internal combustion engine 14 nor the torque generation assembly 16 need be operated or "activated" in order to cool the torque generation assemblies 14, 16, since the variable speed pump 28 operates independently from the operation of the internal combustion engine 14 and operates independently from the operation of the torque generation assembly 16. More particularly, the operational speed of the pump 28 is independent from the operational speed of the internal combustion engine 14, (and from the operational speed of the torque generation assembly 16), thereby allowing the pump 28 to be efficiently operated and allowing the radiator assembly 23 to be relatively small since neither torque generation assembly 14, 16 needs to be operated in order to have coolant being communicated to one or both of these assemblies 14, 16. It should also be apparent that the cooling assembly 12 may be used in a wide variety of dissimilar vehicles and that it is not limited to use within a hybrid electric vehicle.

In an alternate embodiment of the invention, a first electric valve may be operatively disposed within conduit 27 and a second electric valve may be operatively disposed within conduit 29. The valves may then be controllably coupled to the controller 20, effective to allow controller 20 to meter or control the amount of coolant 25 which traverses each of the conduits 27, 29 (e.g., allowing greater amounts of coolant 25 to e communicated to the "hottest" assembly 14, 16 in a situation where both assemblies 14, 16 are operating). Alternatively, these valves may be operatively placed within and form a part of the pump assembly 28.

It is to be understood that the invention is not limited to the exact construction or method which has been delineated above, but that various changes and modifications may be made without departing from the spirit and the scope of the inventions as are more fully set forth in the following claims.

What is claimed is:

1. An assembly for selectively cooling a motor assembly of a hybrid electric vehicle of the type having an internal combustion engine, said assembly comprising a single radiator assembly which contains coolant and which is coupled to said internal combustion engine and to said motor assembly; a source of energy; a single selectively energizable variable speed pump which is coupled to said radiator assembly; and a controller which is coupled to said selectively energizable variable speed pump and to said source of energy and which selectively energizes said variable speed pump by communicating energy to said variable speed pump from said source of energy, effective to cause said variable speed pump to communicate coolant to said motor without the use of said internal combustion engine and without the use of said motor.

2. The assembly of claim 1 wherein said controller further selectively energizes said variable speed pump, effective to cause said variable speed pump to communicate coolant to said internal combustion engine without the use of said motor and said internal combustion engine.

3. The assembly of claim 2 wherein said controller further selectively energizes said variable speed pump, effective to cause said variable speed pump to operate at a certain speed and to communicate coolant to said internal combustion engine and to said motor.

4. The assembly of claim 3 wherein said internal combustion engine operates at a second certain speed as said coolant is communicated to said internal combustion and wherein said certain speed of said variable speed pump is different from said second certain speed of said internal combustion engine.

5. The assembly of claim 4 wherein said certain speed of said variable speed pump in independent from said second certain speed of said internal combustion engine.

6. The assembly of claim 2 wherein said motor operates at a second certain speed as said coolant is communicated to said motor and wherein said certain speed of said variable speed pump is different from said second certain speed of said motor.

7. The assembly of claim 2 further comprising a first temperature sensor which is coupled to said internal combustion engine and to said controller; and a second temperature sensor which is coupled to said motor and to said controller.

8. The assembly of claim 7 wherein said first temperature sensor senses the temperature of said internal combustion and communicates said sensed temperature to said controller, and wherein said controller only activates said variable speed pump to communicate coolant to said internal combustion engine when said sensed temperature exceeds a certain value.

9. The assembly of claim 7 wherein said second temperature sensor senses the temperature of said motor and communicates the sensed temperature to said controller, and wherein said controller only activates said variable speed pump to communicate coolant to said motor when said sensed temperature exceeds a certain value.

10. The vehicle of claim 9 wherein said electric motor and said internal combustion engine are each coupled to said radiator assembly by the use of a common conduit.

11. A hybrid vehicle comprising an internal combustion engine; a battery; a motor; a single variable speed pump; a single reservoir of coolant which is coupled to said internal combustion engine and to said motor; and a controller which selectively activates said variable speed pump by coupling said battery to said variable speed pump, effective to cause said variable speed pump to communicate coolant from said reservoir to said motor without the use of said internal combustion engine without the use of said motor.

12. The hybrid vehicle of claim 11 further comprising a temperature sensor which is coupled to said motor and to said controller, which senses a temperature of said motor, and which communicates said sensed temperature to said controller, wherein said controller activates said variable speed pump only when said sensed temperature exceeds a certain value.

13. The hybrid vehicle of claim 11 wherein said controller further selectively activates said variable speed pump, effective to cause said variable speed pump to communicate coolant from said reservoir to said internal combustion engine when said motor is deactivated.

14. The hybrid electric vehicle of claim 13 further comprising a second temperature sensor which is coupled to said internal combustion engine and to said controller, which senses a temperature of said internal combustion engine, and which communicates said sensed temperature to said controller, wherein said controller activates said variable speed pump only when said caused sensed second temperature exceeds a certain value.

15. A method for cooling an engine and a traction motor of a hybrid electric vehicle, said method comprising the steps of:

providing a single reservoir of coolant;

providing a single variable speed electrically driven pump assembly including a pump which may be operated at a speed which is independent of the speeds of said engine and said traction motor torque generation assembly;

coupling said reservoir of coolant to said engine and said motor;

coupling said variable speed pump to said reservoir of coolant, thereby communicating coolant to said engine and said motor;

sensing the temperature of said engine and said motor; and actuating said variable speed pump in response to a sensed temperature of at least one of said engine and said motor.

* * * * *